United States Patent [19]

Biedermann

[11] 4,090,600

[45] May 23, 1978

[54] PRINTING DEVICE FORMS COMPENSATION AND RIBBON CONTROL MEANS

[75] Inventor: Horst H. Biedermann, Augsburg, Germany

[73] Assignee: NCR Corporation, Dayton, Ohio

[21] Appl. No.: 773,105

[22] Filed: Feb. 28, 1977

[30] Foreign Application Priority Data

Sep. 22, 1976 Germany ..... 2642540

[51] Int. Cl.[2] ..... B41J 33/58; B41J 3/12

[52] U.S. Cl. ..... 400/213; 400/56; 400/58; 400/124

[58] Field of Search ..... 101/93.03, 93.05; 197/1 R, 157, 158, 166, 167

[56] References Cited

U.S. PATENT DOCUMENTS

| | | | |
|---|---|---|---|
| 677,111 | 6/1901 | Brooks | 197/158 |
| 2,312,314 | 3/1943 | Bordonaro | 197/158 |
| 3,750,792 | 8/1973 | Liles | 197/1 R |
| 3,758,012 | 9/1973 | Bonner et al. | 197/168 UX |
| 3,863,749 | 2/1975 | Perry et al. | 197/158 X |
| 3,882,985 | 5/1975 | Liles | 101/93.05 X |
| 3,904,010 | 9/1975 | Krauss et al. | 197/1 R |
| 3,904,011 | 9/1975 | Matschke | 197/1 R |
| 4,010,834 | 3/1977 | Linder | 101/93.03 X |

FOREIGN PATENT DOCUMENTS

| | | | |
|---|---|---|---|
| 2,246,243 | 4/1973 | Germany | 197/1 R |
| 2,248,262 | 4/1974 | Germany | 197/1 R |
| 2,318,947 | 10/1974 | Germany | 197/1 R |
| 2,321,017 | 11/1974 | Germany | 197/1 R |
| 2,409,060 | 8/1975 | Germany | 197/1 R |
| 1,455,915 | 11/1976 | United Kingdom | 197/151 |

*Primary Examiner*—Paul T. Sewell

*Attorney, Agent, or Firm*—J. T. Cavender; Albert L. Sessler, Jr.

[57] ABSTRACT

A printing device is provided in which a flexible strip supported by a fixed guide bar extending over the full printing width of the printing device serves to press the record media into contact with the printer platen to achieve more accurate control of the printing impacts, and serves as a track for guide rollers associated with the print head, thus giving a smooth transition between adjacent different thicknesses of record media in the printing device. The flexibility and low co-efficient of friction of the strip allow insertion and movement of the record media without raising the strip or the printing head. The guide bar acts as a guide for insertion of the record media, and also provides a camming surface co-operating with a suitable follower operatively connected to the print ribbon cassette so as to rock the cassette laterally to minimize the ribbon wear as the print head traverses a line of printing. The bar may also be designed to co-operate with a cover enclosing the print mechanism.

6 Claims, 4 Drawing Figures

PRINTING DEVICE FORMS COMPENSATION AND RIBBON CONTROL MEANS

BACKGROUND OF THE INVENTION

In the field of high-speed printing devices which are especially suitable for use in connection with electronic data processing systems, the wire matrix type of printer has come into increasing use. In this type of printer, letters, numbers and symbols are formed from a series of dots produced by the impact of the ends of a plurality of wire elements on record media, most customarily in combination with an ink ribbon which provides the ink needed to produce a mark on the record medium being printed upon.

Since the wires employed in the matrix printer have a short operating stroke, it is important that a uniform distance be maintained between the print head and the upper surface of the medium being printed upon. It is therefore important, in those cases in which a plurality of different thicknesses of record media may be printed upon by a matrix printer, to provide a compensating device which acts to maintain the same relative distance between the print head and the upper surface of the record media regardless of changes in the thickness of the record media.

In order to maximize efficiency and economy of operation in wire matrix printers it is also important to obtain the maximum utilization of the ink ribbon which is employed with the printer, and to prevent excessive wear in any one area of the ribbon. It is thus quite advantageous, in those instances in which the width of the ribbon exceeds the corresponding dimension of the character being printed, to provide means whereby different transverse portions of the ribbon can be employed during printing, so that the entire ribbon is used in a relatively uniform manner, and the frequency of changing of the ribbon can be reduced.

Various compensation devices for maintaining a predetermined distance between the print head and the record media regardless of the thickness of the record media are known in the prior art. For example, the German Offenlegungsschrift No. 2246243 and Auslegeschrift No. 2321017 both utilize an arrangement in which print head guide rollers are run along a flexible tape secured at its ends. However in those arrangements the tape and print head must be raised for insertion and movement of the paper, owing to the lateral instability of the unsupported central portions of the tape. Another patent showing the use of a flexible tape on which a forms compensator sensing device rides in U.S. Pat. No. 3,750,792. Again in this patent, the arrangement of elements is not such that the record media can be conveniently inserted without movement of the tape. Other patent references showing various printing arrangements are U.S. Pat. Nos. 1,988,189; 3,720,298; 3,904,018; and 3,990,560; and the German Offenlegungsschrift No. 2318947.

SUMMARY OF THE INVENTION

This invention relates to a printing device control means, and more particularly relates to a device for printing on record media with a printing head which is movable transversely to the direction of introduction of the record media into the printing device, said printing head being maintained at a desired distance from the record media by a novel compensating means. An ink ribbon which is used in connection with the printing head is caused to shift transversely during movement of the printing head in order to provide an even distribution of wear of the ribbon and thus lengthen its effective life.

According to one embodiment of the invention, a printing device for printing on record media comprises a carriage; printing means including a print head and ribbon means having a printing ribbon positioned in operative relation to the print head and the record media, said printing means and said carriage being capable of relative movement therebetween; guide means having an operating surface which in non-parallel to the path of relative movement between the printing means and the carriage; and sensing means associated with said ribbon means and coacting with said operating surface of said guide means to cause said ribbon means to shift position with respect to said print head during relative movement between the printing means and the carriage to cause different transverse portions of the printing ribbon to be located in operative relation to said print head.

According to another embodiment of the invention, a printing device for printing on record media which may be of different thicknesses, said record media being introduced to the printing device in a given direction, comprises a carriage; printing means, said printing means and said carriage being capable of relative movement therebetween in a direction transverse to the direction of introduction of the record media to the printing device; guide means positioned transversely to the direction of introduction of the record media to the printing device extending substantially from one end of the carriage to the other and including a flexible strip secured substantially continuously along one longitudinal edge and overlying record media positioned in the printing device for printing; and sensing means associated with the printing means and coacting with said flexible strip to maintain a predetermined distance relationship between the printing means and the upper surface of the record media to be printed upon, regardless of variations in the thickness of the record media.

It is accordingly an object of the present invention to provide a printing device having a novel compensating means for maintaining a given distance between a printing head and the record media to be printed upon, regardless of the thickness of said media.

Another object is to provide a printing device having means for causing a printing ribbon to be shifted laterally across a printing head during movement of the printing head in order to cause the printing ribbon to be fully utilized, and to extend the life thereof.

A further object of the present invention is to provide a printing device in which it is possible to insert the record media to be printed upon into the printing device in a simple manner with a minimum likelihood of damage to the record media.

A further object of the invention is to provide, in a printing device, a laterally inclined operating surface on a guide member, to cause movement of the ink ribbon in an advantageous manner for its more effective utilization.

With these and other objects, which will become apparent from the following description, in view, the invention includes certain novel features of construction and combinations of parts, a plurality of embodiments of which are hereinafter described with reference to the drawings which accompany and form a part of this specification.

DESCRIPTION OF THE PREFERRED EMBODIMENT

Figure 1:
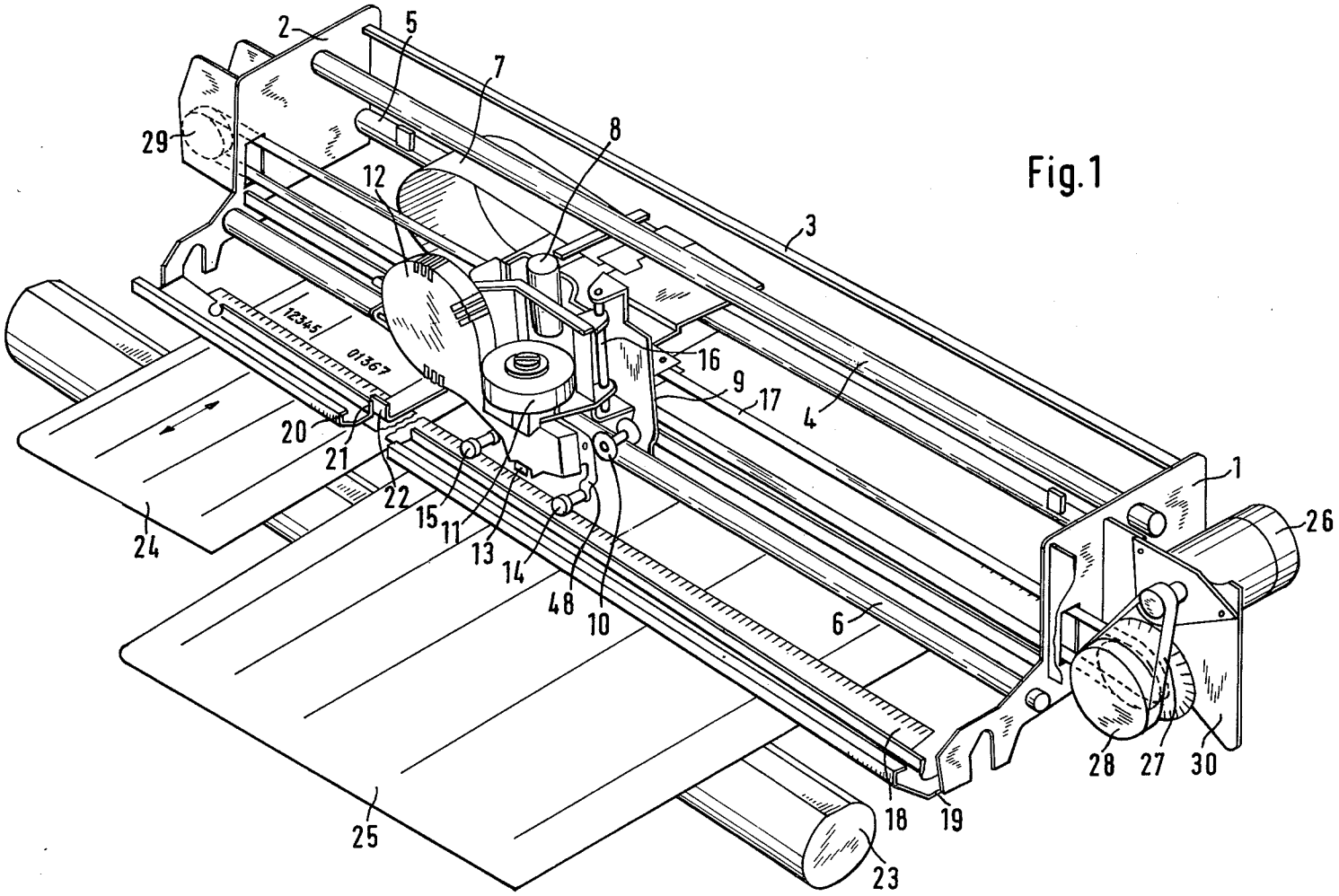
FIG. 1 is a perspective view of the printing device of the present invention.

Referring now to FIG. 1, the printing device shown there comprises a right side wall 1 and a left side wall 2 which are connected with each other by a posterior part 3 as well as by rods 4, 5 and 6, the parts, 2, 3, 4, 5 and 6 taken together forming a frame.

The rods 4, 5 and 6 serve to guide a mosaic or matrix printing head 11 which can be moved by a driving belt 17 within the two side walls 1 and 2. The drive is effected by a motor 26 which drives a belt pulley 28 via a belt 27. The motor 26 is mounted on an appropriate flange 30 which is fixed to the side wall 1. The driving belt 17 for the mosaic printing head 11 is guided around the driving belt pulley 28 as well as around a belt pulley 29 which is arranged at the left side wall 2. The driving belt 17 is connected to the printing head 11 in a conventional manner so that the printing head can be positioned in dependence on the control of the motor 26 at any desired position between the right side wall 1 and the left side wall 2.

The printing device which comprises the print head 11 and a ribbon cassette 12 associated therewith slides over rollers, the right one 10 of which is shown, along the aforementioned rods arranged between the right side wall 1 and the left side wall 2. The roller 10 is arranged above the rod 6.

Via a flexible conductor tape 7 the supply of the control energy to the printing head 11 as well as of the various control and supervisory signals is accomplished.

The printing head 11 and the cassette 12 are mounted to be shiftable in a vertical direction by bearing 16 and a second similar bearing (not shown) so that with the aid of an electric motor 8 the printing head 11 and the ribbon cassette 12 can be lifted. The bearing 16 and the second bearing are mounted on a frame 9, portions of which are bent over to hold the bearings.

A platen 23, which may be mounted, for instance, between the extensions (not shown) of the two side walls 1 and 2, constitutes the abutment for the individual printing needles of the printing head 11. The upper part of the platen 23 lies opposite to the printing needles 13 and takes the form of a planar surface in order to obtain an improved printing quality.

Between the right side wall 1 and the left side wall 2 there is arranged a U-shaped guiding element 19 which comprises two projecting flanges 20 and 21. Whereas the front flange 20, the upper part of which is bent inwards, in order to prevent possible injury to an operator of the printing device, runs parallel to the rod 6, i.e. to the transport direction of the printing head 11, the inner flange 21 is arranged in a laterally inclined manner, i.e. the distance between the flange 21 and the printing needles 13 of the printing head is greater at the right-hand position of the printing head than the distance between the flange 21 and the printing needles 13 at the left-hand position of the printing head 11. As used herein, the terms "right-hand" and "left-hand" refer to the location of the printing head arrangement either in the furthest right position adjacent to the right side wall 1 or in the furthest left position adjacent to the side wall 2, as viewed in FIG. 1.

As may be gathered from FIG. 1, the guiding element 19 of the exemplified embodiment is configured in such a way that its bottom portion is continuously diminished in its width from the left to the right. Instead of the continuous uniform reduction in width from one side to the other, it is possible to apply any other configuration to the bottom portion, within the scope of the invention, so that for example, the flange 21 may take the shape of a curve between its ends.

Figure 3:
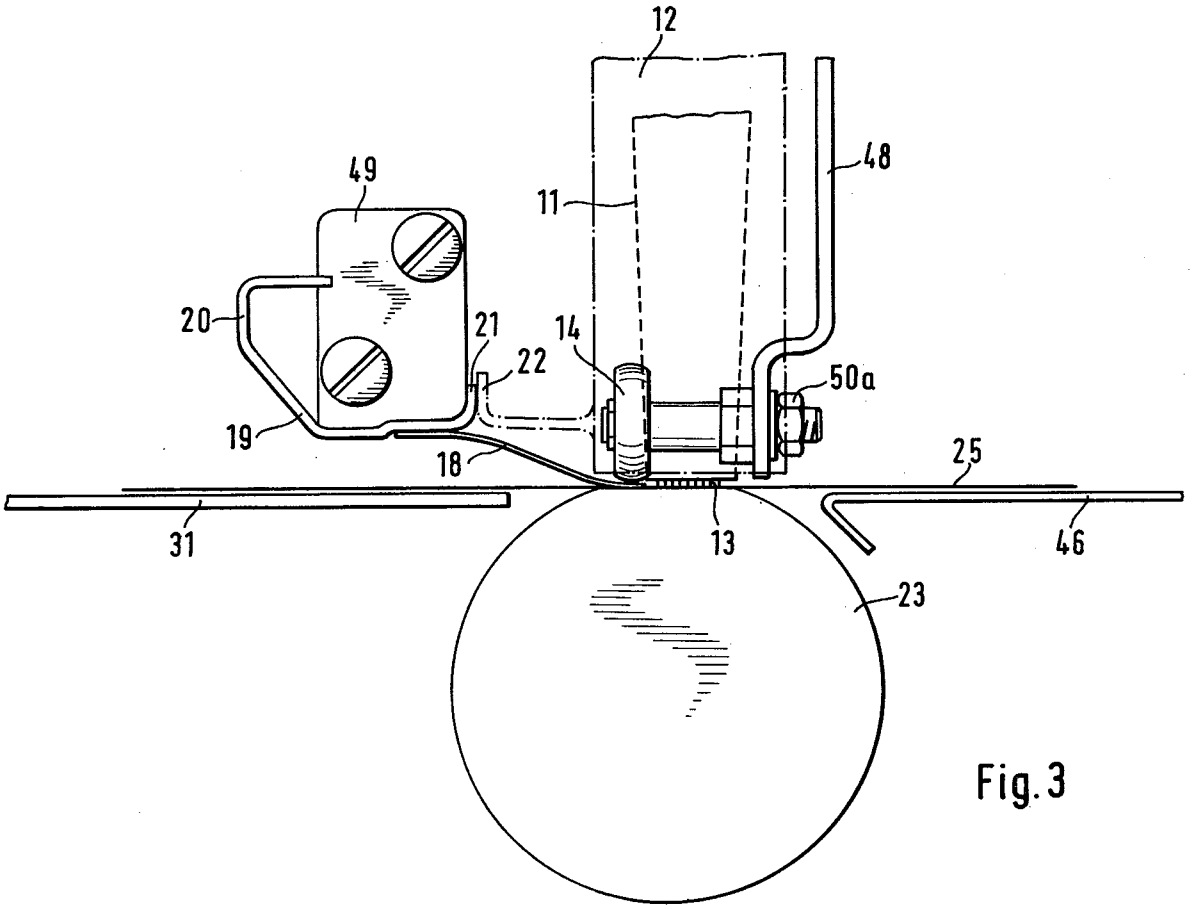
FIG. 3 is an enlarged simplified view of a portion of the printing device shown in FIG. 1.

To the bottom portion of the guiding element 19 there is connected a thin flexible strip 18, for instance a thin metallic strip, in such a way that one longitudinal edge of the strip 18 is for instance welded or adhered to the overall length of the guiding element 19, whereas the other longitudinal edge extends to the printing needles 13 of the printing head 11. By means of this advantageous arrangement and mounting of the flexible strip 18 a reliable insertion of record media is rendered possible without running the risk that the front edge of the record media which is to be inserted will be damaged. In order to avoid damage to the thin metal foil when the record media forms are withdrawn or ejected after having been printed on, the metal foil is rounded off on its right side (FIG. 3).

In the exemplified embodiment as shown in FIG. 1, for instance, two record media 24 and 25 which have different thicknesses are introduced, independently of each other, from the front side via the platen 23 into the printing device, i.e. underneath the guiding element 19. During this operation the printing head 11 and the ink ribbon 12 can be lifted by means of the motor 8 so that it is possible to insert extremely thick record media in a simple manner. After one or several record media have been introduced beneath the guiding element 19 into a desired line position for printing, the printing head 11 is lowered so that the rollers 14 and 15, which are connected with said printing head, press onto the flexible strip 18 by the gravity of the complete printing head and ink ribbon arrangement. During the following printing operations, in the course of which the printing head arrangement is moved into various positions by means of the driving belt 17, the rollers 14 and 15 slide along the flexible strip 18 so that, independently of the thickness of the record medium which is to be printed on, a constant distance between the printing needles and the surface of the record media lying opposite thereto is maintained. Due to said constantly maintainable needle stroke distance, it is possible to achieve a very high quality of printing, since the individual printing needles strike onto the record media with constant pressure. The rollers 14 and 15 are connected via curved links with the printing head arrangement, only the front link 48 of which is shown in FIG. 1. Hence, it is possible by the fastening, according to the invention, of the flexible strip 18 to the guiding element 19 to insert one or several record media in a simple, reliable, quick manner without damage, since the front flange 20 of the rigid guiding element 19 and the platen 23 shape an exact and sufficiently wide slot for the insertion.

By means of the advantageous design of the rigid guiding element 19, the guidance of the ink ribbon, i.e. of the cassette 12, is accomplished by the coaction of the flange 21 with a scanner lever 22 connected to the ribbon cassette 12. In connection with FIG. 4 there will subsequently be described the manner in which, during the positioning of the printing head, pressure is put on the cassette 12 or on the scanning lever 22, respectively, so that with the movement of the printing head transverse to the insertion direction of the record media, the ink ribbon being issued from the cassette 12 is guided in a laterally inclined path beneath the printing needles 13. This is advantageous since a much more economic and effective exploitation of the ink ribbon in the cassette 12 is possible than if the cassette 12 were not pivoted.

Figure 2:
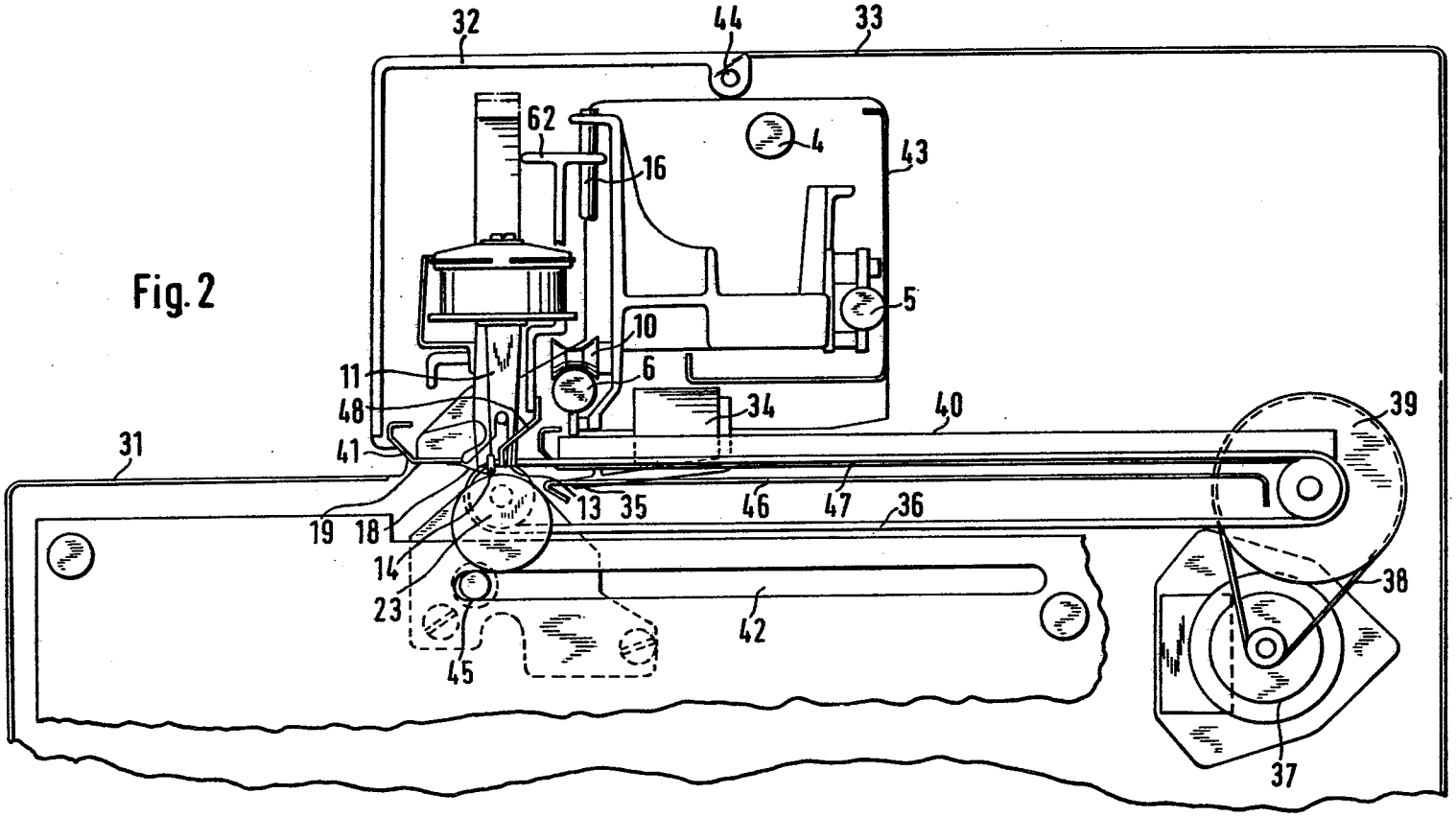
FIG. 2 is a side view of a modified form of the printing device illustrated in FIG. 1.

The record media 24 and 25 shown in FIG. 1 may be inserted by hand from the front side into the printing device. FIG. 2 shows an automatic insertion mechanism, whereby in FIG. 2 the design of the rigid guiding element 19 with regard to the design according to FIG. 1 is somewhat changed. In FIG. 2 the record media which are to be printed on can be inserted via the printing table 31, being arranged horizontally, into the device so that they pass beneath the front edge 41 of a rigid guiding element 19 and beneath the flexible strip 18, which is connected with the rigid guiding element 19, over the platen 23. Subsequently, an inserted record medium is seized by grapple claws 35 which are respectively associated with an electromagnet 34. Any number of electromagnets 34 can be arranged transversely to the insertion direction of the record media which are to be printed on. Because the electromagnets 34, only the outside right one of which is shown in FIG. 2, are individually controllable, individual insertion controls, independent of each other, for various record media which are to be printed on, may be employed. The electromagnets 34 are guided and controlled by guiding means and driving means 40, 46, 47, 36, 37, 38, 39. By means of driving belts 36 which are fastened to the electromagnets 34 and driven by driving means 37, 38 and 39, it is possible to move the inserted record medium from the left to the right side into the respective printing position, and after they have been printed on, to move them out of the device. Thereby the sliding surfaces 46 and 47 shape a path of motion for the inserted record media.

In order to muffle the intensive noise usually produced by printers, the printing head arrangement is covered in an advantageous manner in the embodiment according to the invention by a cowl 32 which may be of transparent plastic material, and which is pivotable about a point 44. The remaining part of the printing device is protected by a common covering 33. For the performance of repairs it is possible to remove the whole printing and covering device to the rear, i.e. to the right, as shown in FIG. 2, whereby the printing and covering device is guided over respective sliding means 45 within a slot 42.

As already mentioned, in the embodiments shown herein, respective identical parts are provided with the same reference numbers. The printing head 11 in FIG. 2 is firmly supported by means of a support member 62, since in the exemplified embodiment according to FIG. 2 the rigid guiding element 41 comprises only one anterior flange, whereby the flexible strip 18 is arranged at the bottom portion. In contrast to the advantageous design of the guiding element 19 in FIG. 1, no pivot motion of the ribbon cassette is performed in the embodiment according to FIG. 2 because of the more simple construction of the guiding element 41, i.e. without the inclined second flange. The further construction and the further manner of operation are comparable or identical, respectively, to the construction and manner of operation of the embodiment of FIG. 1.

FIG. 3 is an enlarged simplified side view of the embodiment shown in FIG. 1. The rigid guiding element 19 in FIG. 3 is arranged with its posterior part, i.e. with its left part, at the securing portion 49. The scanning lever 22 which is connected with the ribbon cassette 12 is shown in dotted lines in FIG. 3, since its absolute local position depends on the respective position of the printing head arrangement. In FIG. 3 there is only shown the anterior guide roller 14 which rolls over the flexible strip 18. As best shown in FIG. 3, a record medium 25 is pushed over the printing table 31, then beneath the flexible strip 18 and the printing needles 13, so that it arrives at the guide plate 46. As has been described in connection with FIG. 2, an automatic insertion device which may be arranged above the guide plate 46 can seize the record medium 25 and pull it into the device for the various printing operations, and subsequently transport it out of the device. The flexible strip 18 in FIG. 3, which is fixed below the partially upwardly displaced interior bottom portion of the U-shaped rigid guiding element 19, terminates to the left of the printing needles 13 so that they are not hindered by the flexible strip 18. Immediately to the left of the printing needles 13, the roller 14 slides over the posterior end of the flexible strip 18, whereby a respective exact pressure of the record medium 25, which is to be printed upon, onto the platen 23 is effected. The pressure is brought about by the gravity of the complete printing head arrangement, since the latter as already mentioned has a vertical component of force because of the mounting at the bearing 16.

Thereby it is achieved that for the printing needles 13, independent of the thickness of the record medium 25 or 26 which is to be printed upon, a constant length of stroke is effected. Furthermore, thereby it is avoided that due to record media of different thicknesses, which lie side by side and are to be printed on in one processing operation, impacts or other troubles occur, since the flexible strip 18 extends entirely across the width of the printing table and therefore a continuous passing over differently thick record media lying side by side is achieved for the printing device. The printing head 11 is operatively connected to the roller 14 by means of a screw 50*a* at a cranked link 48.

Figure 4:
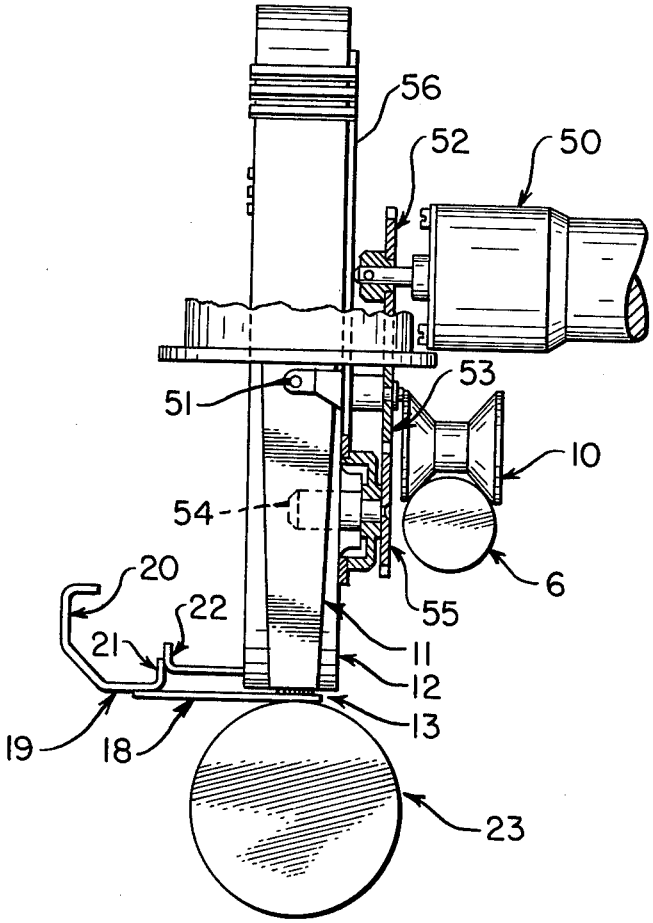
FIG. 4 is a side view of another slightly modified embodiment of the printing device shown in FIG. 1.

With the aid of FIG. 4, the pivot motion of the ribbon cassette shown in FIGS. 1 and 3 will now be described. The ribbon cassette 12 shown in FIG. 4 is usually exchangeable. When the ribbon cassette 12 is placed into the printing device, it is connected with a ribbon drive 54. The ribbon drive 54 is connected via a first gear wheel 55 with an intermediary gear wheel 53 which for its part is connected with a driving gear wheel 52. The gear wheel 52 is connected to a shaft of a driving device 50, of which only a part is shown. Usually the driving device 50 consists of an appropriate motor. The parts 50, 52, 53, 54 and 55, together with the cassette 12, are fixed together for unitary movement by a frame 56, shown in part in FIG. 4, to pivot about the rod 51, so that the lower end of the cassette 12 is pressed by a horizontal component of the force of gravity of the driving device 50 to the left. By this deviation to the left the scanning lever 22 is constantly pressed against the inner flange 21 of the rigid guiding element 19. Consequently, as has been described already, the ink ribbon (not shown) which is issued from the cassette 12 is guided beneath the printing needles 13 during a movement of the printing device from the left to the right or vice versa in an inclined path so that with the application of multiple passages of the cassette from one side wall to the other, the ink ribbon, which passes in a plurality of passages beneath the printing needles 13, is used on diverse portions thereof. The total exploitation of the ink ribbon is thereby essentially increased, which also results in an improvement of the printing quality. The other parts shown in FIG. 4 correspond to the already described parts.

As already mentioned in connection with the specification of the exemplified embodiment, particularly shaped guiding elements 19 can be used for the individual cases of application in order to achieve an optimal exploitation of the ink ribbon. Furthermore, with regard to the design of the guiding element 19 and the fastening of the flexible strip 18 thereto, the dimensioning and fixing in dependence upon the respective requirements of the diverse scopes of application can be altered in an appropriate manner.

What is claimed is:

1. A printing device for printing on record media, comprising:

a first frame, printing means including a print head mounted on said first frame and including a second frame, ribbon means including ribbon driving means supported on said second frame means pivotally mounting said second frame and said ribbon means to said printing means, said ribbon means including a printing ribbon positioned in operative relation to the print head and the record media, said printing means and said first frame being capable of relative movement therebetween;

guide means secured to said first frame and having an operating surface which is non-parallel to the path of relative movement between the printing means and said first frame; and sensing means operatively coupled to said ribbon means and being urged by the force of gravity acting on said ribbon means including said ribbon driving means into engagement with said operating surface of said guide means to cause said ribbon means to shift position with respect to said print head during relative movement between the printing means and the first frame to cause different transverse portions of the printing ribbon to be located in operative relation to said print head.

2. The printing device of claim 1 in which said guide means includes a turned-over flange portion which is parallel to the direction of relative movement of the printing means and the first frame and in which said operating surface on the guide means is laterally inclined with respect to said flange portion.

3. The printing device of claim 2 in which the turnedover flange portion of the guide means is positioned to facilitate the introduction of record media into the printing device.

4. The printing device of claim 1 in which said sensing means comprises a follower which engages said operating surface and is operatively connected to said ribbon means.

5. A printing device for printing on record media which may be of different thicknesses, said record media being introduced to the printing device in a given direction, comprising:

a first frame having end walls;

printing means including a print head, a second frame, and ribbon means including ribbon driving means pivotally mounted on said second frame and having a ribbon disposed in operative relation to said print head means pivotally mounting said second frame and ribbon means to said printing means said printing means being movable on said first frame in a direction transverse to the direction of introduction of the record media to the printing device;

guide means positioned transversely to the direction of introduction of the record media to the printing device, extending between the end walls of the first frame and secured thereto, said guide means including a flexible strip secured substantially continuously along one longitudinal edge of the guide means and overlying record media positioned in the printing device for printing, said guide means also including a surface which is nonparallel to the path of movement of the printing means on the first frame;

first sensing means associated with the printing means and co-acting with said flexible strip to maintain a predetermined distance relationship between the printing means and the upper surface of the record media to be printed upon, regardless of variations in the thickness of the record media; and second sensing means operatively connected to the ribbon means and being urged against said surface of the guide means by the force of gravity acting on said ribbon means to cause different transverse portions of said ribbon to be located in operative relation to said print head for printing as said printing means moves on said first frame, to thereby extend the useful life of the ribbon.

6. The printing device of claim 5 in which the first sensing means comprises roller means riding on the flexible strip.

* * * * *

UNITED STATES PATENT OFFICE

CERTIFICATE OF CORRECTION

Patent No. 4,090,600 Dated May 23, 1978

Inventor(s) Horst H. Biedermann

It is certified that error appears in the above-identified patent and that said Letters Patent are hereby corrected as shown below:

Column 2, line 7, delete "carriage" and substitute --first frame--.

Column 2, line 7, delete "and" and insert --mounted on said first frame and including a second frame,--.

Column 2, line 8, delete "having" and insert --including ribbon driving means supported on said second frame, means pivotally mounting said second frame and said ribbon means to said printing means, said ribbon means including--.

Column 2, line 10, delete "carriage" and substitute --first frame--.

Column 2, line 11, after "means" insert --secured to said first frame and--.

Column 2, line 14, delete "the carriage" and substitute --said first frame--.

Column 2, line 14, delete "associated" and substitute --operatively coupled to--.

Column 2, line 15, delete "coacting" and insert --being urged by the force of gravity acting on said ribbon means including said ribbon driving means into engagement--.

Column 2, line 18, delete "carriage" and substitute --first frame--.

UNITED STATES PATENT OFFICE

CERTIFICATE OF CORRECTION

Patent No. 4,090,600 Dated May 23, 1978

Inventor(s) Horst H. Biedermann

It is certified that error appears in the above-identified patent and that said Letters Patent are hereby corrected as shown below:

Column 2, line 26, delete "carriage" and substitute --first frame having end walls--.

Column 2, line 26, after "means" insert --including a print head, a second frame, and ribbon means including ribbon driving means mounted on said second frame and having a ribbon disposed in operative relation to said print head, means pivotally mounting said second frame and ribbon means to said printing means--.

Column 2, line 27, delete "and said carriage".

Column 2, line 27, delete "capable of relative move-".

Column 2, line 28, delete "ment therebetween" and substitute --movable on said first frame--.

Column 2, line 32, after "device" insert --,--.

Column 2, line 32, delete "substantially from one end of".

Column 2, line 33, delete "the carriage" and substitute --between the end walls of the first frame and secured thereto, said guide means--.

Column 2, line 33, delete "to the other and".

Column 2, line 35, after "edge" insert --of the guide means--.

UNITED STATES PATENT OFFICE

CERTIFICATE OF CORRECTION

Patent No. 4,090,600 Dated May 23, 1978

Inventor(s) Horst H. Biedermann

It is certified that error appears in the above-identified patent and that said Letters Patent are hereby corrected as shown below:

Column 2, line 36, after "printing" (second occurrence) insert --, said guide means also including a surface which is non-parallel to the path of movement of the printing means on the first frame--.

Column 2, line 36, delete "and" substitute --first--.

Column 2, line 41, after "media" insert --; and second sensing means operatively connected to the ribbon means and being urged against said surface of the guide means by the force of gravity acting on said ribbon means to cause different transverse portions of said ribbon to be located in operative relation to said print head for printing as said printing means moves on said first frame, to thereby extend the useful life of the ribbon--.

Column 5, line 38, delete "me-".

Column 5, line 39, delete "dium" and substitute --media--.

Column 7, line 29, after "frame" insert --,--.

UNITED STATES PATENT OFFICE

CERTIFICATE OF CORRECTION

Patent No. 4,090,600 Dated May 23, 1978

Inventor(s) Horst H. Biedermann

It is certified that error appears in the above-identified patent and that said Letters Patent are hereby corrected as shown below:

Column 8, line 18, delete "pivotally".

Column 8, line 20, after "head" insert --,--.

Column 8, line 21, after "means" (second occurrence) insert --,--.

Signed and Sealed this

Third Day of April 1979

[SEAL]

Attest:

RUTH C. MASON
Attesting Officer

DONALD W. BANNER
Commissioner of Patents and Trademarks